US006723031B1

(12) United States Patent
Wild

(10) Patent No.: US 6,723,031 B1
(45) Date of Patent: Apr. 20, 2004

(54) FEMININE TONING BALLS

(76) Inventor: Patricia A. Wild, 8921 117$^{th}$ Ave., Grande Prairie, Alberta (CA), T8X 1K2

( * ) Notice: Subject to any disclaimer, the term of this patent is extended or adjusted under 35 U.S.C. 154(b) by 86 days.

(21) Appl. No.: 10/234,941

(22) Filed: Sep. 4, 2002

(51) Int. Cl.$^{7}$ ..... A63B 71/00

(52) U.S. Cl. ..... 482/148; 601/70; 601/72; 601/57; 601/113; 601/49; 601/94; 601/137; 128/842; 128/845; 128/859; 128/918; 128/600; 128/38; 128/848

(58) Field of Search ..... 482/148; 601/70, 601/72, 57, 113, 49, 137, 94; 128/842, 844–845, 918, 600, 38, 848, 859

(56) References Cited

U.S. PATENT DOCUMENTS 5,993,377 A * 11/1999 Hartwig ..... 600/38
6,350,230 B1 * 2/2002 Kontos ..... 600/38
6,645,137 B2 * 11/2003 Ulmsten et al. ..... 600/29

OTHER PUBLICATIONS www.mypleasure.com (2000–2004).*
www.sextoyworld.com (1995–2004) All Graphics, Text, RPT Ventures, Inc.*
www.momentum98.com.*

* cited by examiner

*Primary Examiner*—Nicholas D. Lucchesi
*Assistant Examiner*—L Amerson

(57) ABSTRACT

A device for toning the pubococcygeus (PC) muscles is provided. These feminine toning balls comprise a durable device having metal balls connected to each other with a cord and a hard rubber exterior coating, with the cord extending from end of the toning balls for easy retrieval. The coating seamlessly covers said metal balls and is thick enough for the toning balls to withstand repeated used. There are 2 to 5 spherical or ovate balls in a set, which can be used to promote vaginal health and sexual enjoyment.

4 Claims, 3 Drawing Sheets

FEMININE TONING BALLS

BACKGROUND OF THE INVENTION

1. Field of the Invention

The present invention relates to an exercise aid for use in connection with increasing and maintaining vaginal health and sexual enjoyment. The toning balls have particular utility in connection with toning the pubococcygeus (PC) muscles and providing a durable and safe set of toning balls.

2. Description of the Prior Art

The use of small balls use for strengthening the pubococcygeus (PC) muscles and increasing sexual enjoyment is well known. For centuries, Ben Wa balls have been used for strengthening the PC muscles and for sexual enjoyment. Ben Wa balls are spherical balls which can be inserted into the vaginal canal and held in place by controlled muscle movements. These balls are not connected to each other, so the balls will not continually knock against each other and separate causing vibrations within the vagina. When the balls are connected to each other, there is an enhancement of the effectiveness of the exercise the PC muscle receives without consciously controlling the muscle. This limits the effectiveness of the exercises done with the balls. In addition, the lack of a cord makes it more difficult to remove the balls when the exercise is complete. Ben Wa balls are made from various metals or are plated with a metal or a plastic. In some instances, 24 k gold is used to plate the Ben Wa balls to create an inert surface and increase on which bacteria will not grow. This causes the cost of the balls to dramatically increase, and the balls have to be discarded when the gold plating comes off. Other balls may be coated with a thin plastic shell, but with use, this shell deteriorates and creates a surface on which harmful bacteria will grow. Other than Ben Wa balls, Kegal exercises are used to increase the strength of the PC muscle and improve blood circulation to the pelvic area. This exercise has been shown to be effective, but a woman must spend time consciously exercising her PC muscle.

Specific devices for strengthening the PC muscles are known in the prior art. For example, U.S. Pat. No. 3,726,273 to Cole discloses a muscle exercise device for vaginal muscles having inflatable balls connected to each other by a stem. This light and flexible device can be used to measure the amount of tone in the PC muscle. However, Cole's patent does not provide weighted balls, which will vibrate to exercise the PC muscles, and has further drawbacks of not being durable.

U.S. Pat. No. 4,574,791 to Mitchener discloses a muscle-toning device having a soft latex bulbous body and an elastic cable for removal. However, Mitchener's patent does not provide weighted balls, which will vibrate to exercise the PC muscle, and additionally does not provide a durable rubber coating.

Other elongated devices have been developed which can be inserted into the vagina for exercising the PC. U.S. Pat. No. 3,752,150 to Harris discloses an elongated apparatus for measuring tone and exercising the PC muscle using a liquid supply and a pump. This device cannot be worn internally without the presence of an external pump, limiting its usefulness. U.S. Pat. No. 4,106,489 to Martin discloses an elongated device in which an axial force within the device can be controlled externally by the user. This device is not useful for exercise without the conscious external control of the user. Neither of these devices provides weighted balls that will exercise the PC muscle by vibrating.

Other devices known in the art are also available for exercising the PC muscle. Duoton (Vibratone) Balls are two balls encased in a larger plastic sphere joined together with a nylon cord (The Love Boutique, Grand Prairie AB Canada). These balls cause vibration stimulation in the vaginal region and cause muscle contractions that exercise the PC muscles. However, the plastic sphere coating these balls wears rapidly and will tear. Any tear or hole in the plastic exposes the ball material to air and to the warm and moist conditions in the vagina. These conditions coupled with an unsanitary surface drastically increase the chance that harmful bacteria will grow on the balls or on the cord causing irritating and potentially harmful conditions. Therefore, these balls must be discarded after only a few uses, drastically increasing the cost of using the device.

While the above-described devices fulfill their respective, particular objectives and requirements, the aforementioned patents do not describe durable toning balls that allows for exercise of the PC muscles without conscious effort of the user. The above devices make no provision for creating inexpensive toning balls based on exercise through vibrations within the vagina that do not need to be frequently replaced because of wear and cheap manufacture.

Therefore, a need exists for a new and improved set of feminine toning balls that can be used to exercise the PC muscle and for sexual enjoyment that are durable and sanitary. In this regard, the present invention substantially fulfills this need. In this respect, the feminine toning balls according to the present invention substantially departs from the conventional concepts and designs of the prior art, and in doing so provides an apparatus primarily developed for the purpose of toning the PC muscle with a device that is durable and sanitary.

SUMMARY OF THE INVENTION

In view of the foregoing disadvantages inherent in the known types of toning balls now present in the prior art, the present invention provides an improved feminine toning balls, and overcomes the above-mentioned disadvantages and drawbacks of the prior art. As such, the general purpose of the present invention, which will be described subsequently in greater detail, is to provide a new and improved feminine toning balls and method which has all the advantages of the prior art mentioned heretofore and many novel features. This results in a set of feminine toning balls that is not anticipated, rendered obvious, suggested, or even implied by the prior art, either alone or in any combination thereof.

To attain this, the present invention essentially comprises feminine toning balls comprising a plurality of metal balls connected to each other with a cord, having an exterior coating comprising a hard rubber. The exterior coating seamlessly covers the balls and the cord extends from one of the metal balls for easy retrieval. There are 2–5 connected balls in the toning balls that are spherical, ovate, or prolate. The rubber exterior coating is preferably a latex-free rubber suitable for inter-body use and is thick enough to prevent rapid wear and tearing.

There has thus been outlined, rather broadly, the more important features of the invention in order that the detailed description thereof that follows may be better understood and in order that the present contribution to the art may be better appreciated.

The invention may also include a novelty feature such as adding color or patterns on the surface of the balls to enhance the enjoyment of using the balls. Similarly, the outer coating of the balls may comprise a glow-in-the-dark material.

There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. In addition, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved set of feminine toning balls that have all of the advantages of the prior art toning and none of the disadvantages.

It is another object of the present invention to provide a new and improved set of feminine toning balls that may be easily and efficiently manufactured and marketed.

An even further object of the present invention is to provide a new and improved set of feminine toning balls that have a low cost of manufacture with regard to both materials and labor but yet retain their durability, and which accordingly is then susceptible of low prices of sale to the consuming public, thereby making such feminine toning balls economically available to the buying public.

Still another object of the present invention is to provide new feminine toning balls that provide in the apparatuses and methods of the prior art some of the advantages thereof, while simultaneously overcoming some of the disadvantages normally associated therewith.

Lastly, it is an object of the present invention to provide a new and improved method for using the feminine toning balls of the current invention that includes lubricating and inserting the toning balls as described herein into the vagina.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

The device of the current invention is used to exercise and strengthen the pubococcygeus (PC) muscles. This sling of muscles supports the pelvic floor and surrounds the genital organs. A weak PC muscle can lead to urinary or stool incontinence, poor muscle control during labor and delivery, a decrease in sexual pleasure or genital prolapse.

The feminine toning balls as described herein fulfill a need for high quality exercise and sexual experience enhancers. These balls will wear better and are more sanitary and safe than devices known in the art. The toning balls are worn internally by women by sequentially inserting the balls into the vaginal canal. As the balls move within the vaginal canal, they will knock against each other and vibrate. When the internal muscles in the vaginal canal are exposed to the vibration of the balls, they will contract. These contractions in turn strengthen the walls of the vaginal canal. The toning balls can be worn for hours without discomfort and provide the PC muscles with exercise.

As used herein, the term "balls" refers to spherical shapes as well as ovate (egg-shaped), prolate, or oblate forms wherein a diameter in one dimension is at most twice the length of a diameter in an opposite dimension.

Figure 1:
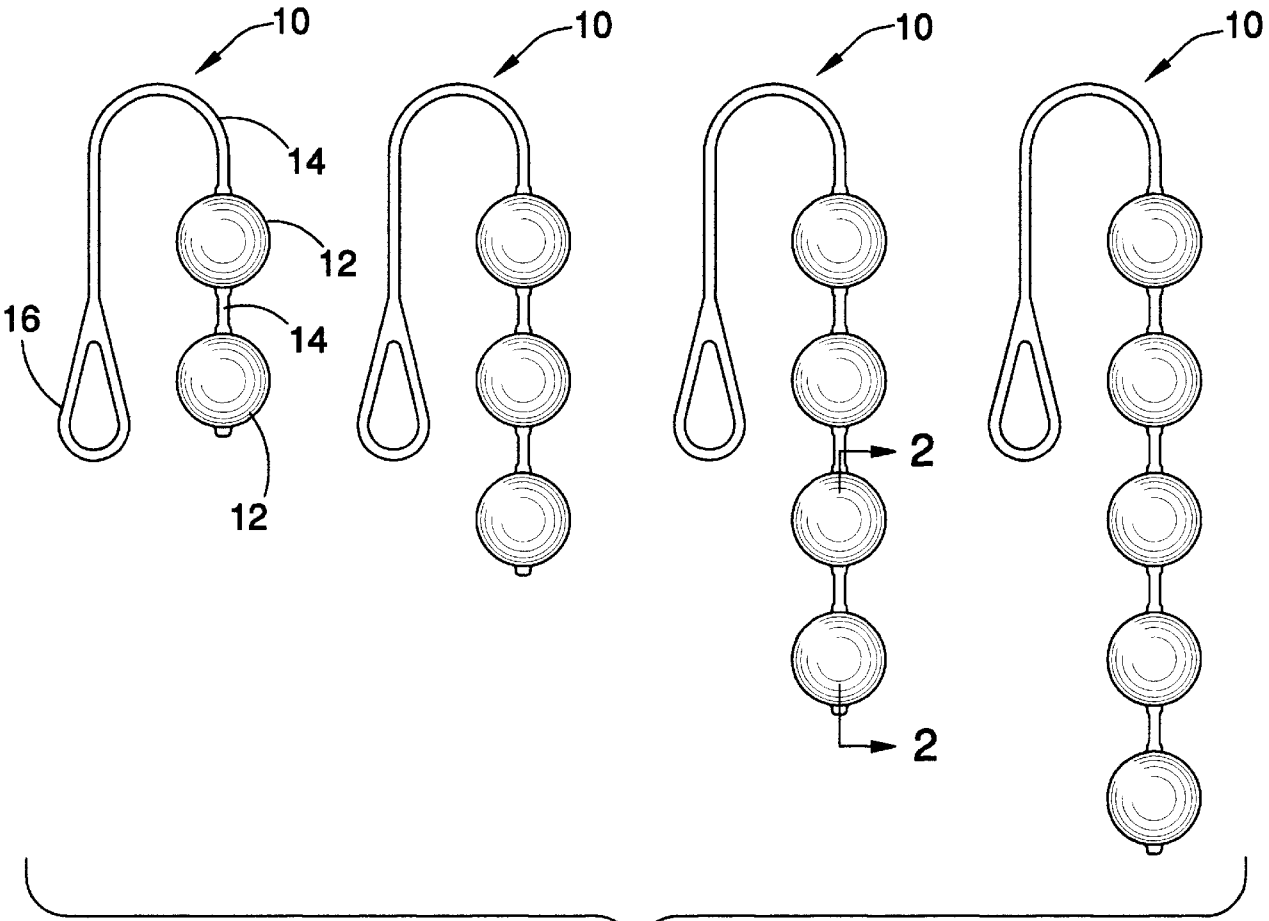
FIG. 1 is a front view of four preferred embodiments of the feminine toning balls having 2, 3, 4, and 5 spherical balls constructed in accordance with the principles of the present invention.
Figure 2:
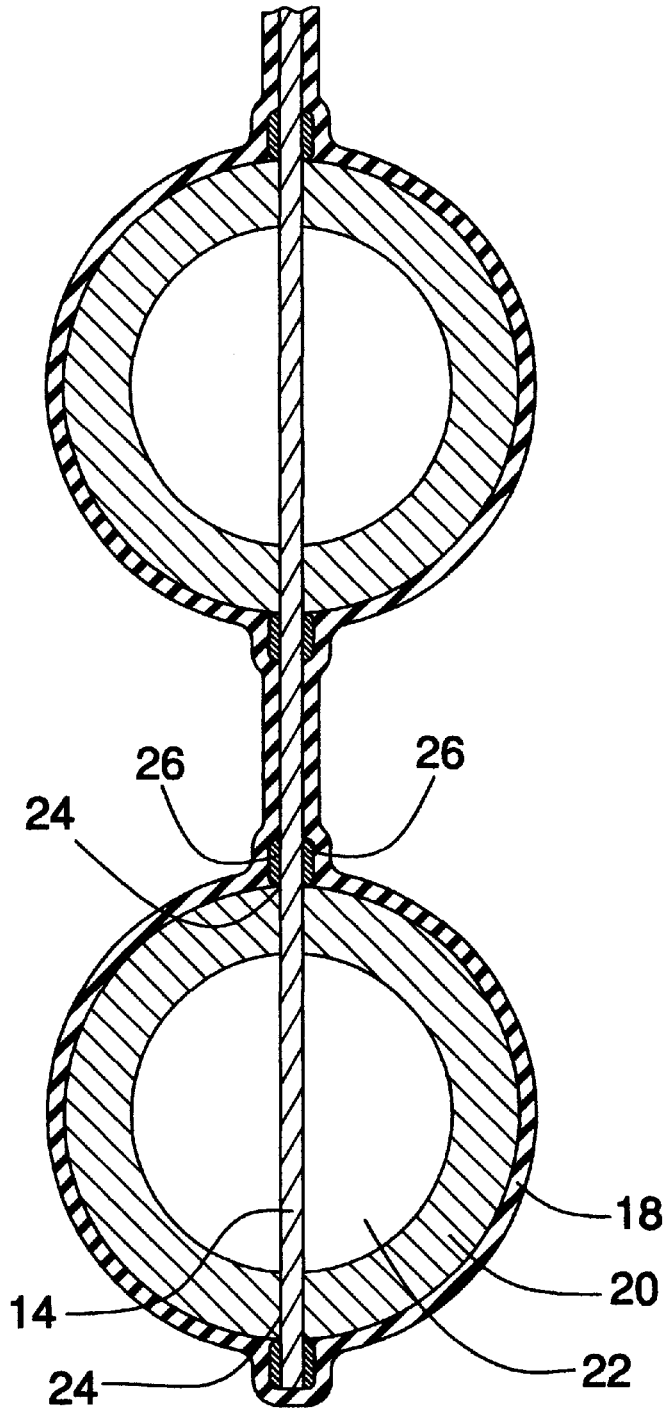
FIG. 2 is a cut-away view of the feminine toning balls of the present invention showing the interior of 2 spherical balls.
Figure 3:
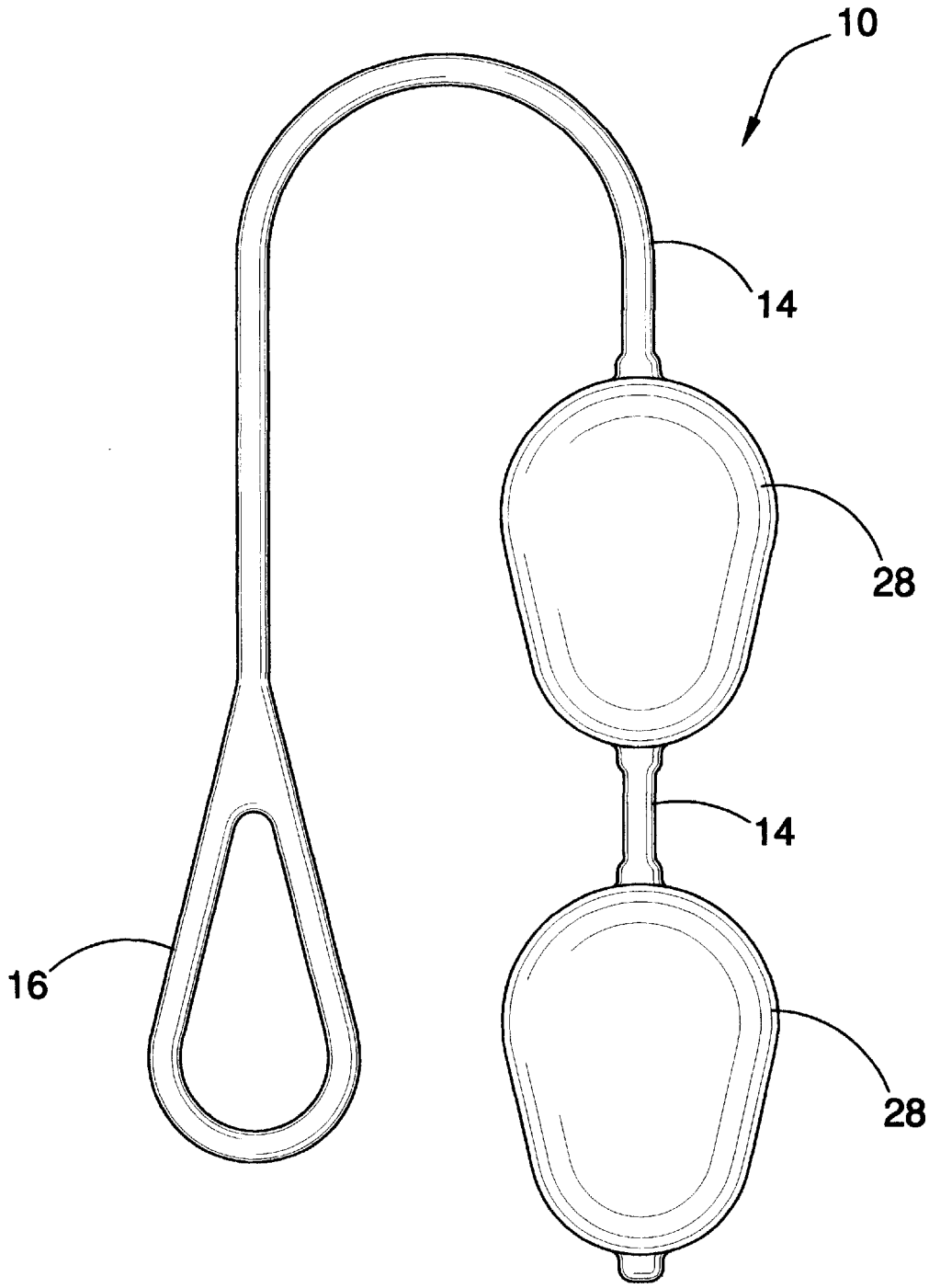
FIG. 3 is a front view of the feminine toning balls of the present invention having 2 ovate balls.

Referring now to the drawings, and particularly to FIGS. 1–3, a preferred embodiment of the feminine toning balls of the present invention is shown and generally designated by the reference numeral 10.

In FIG. 1, a new and improved set of feminine toning balls 10 of the present invention for toning the PC muscles are illustrated and will be described. More particularly, the set of feminine toning balls 10 have two or more balls 12 connected together by a cord 14. The cord 14 connects the balls by entering a first ball on one side and running through the entire diameter of the ball; the cord 14 then exiting from opposite sides of the ball 12 and enters a second ball. The spacing of the cord 14 between the balls 12 is between 5 and 50 mm. The current invention comprises a plurality of toning balls that are supplied in set of 2, 3, 4, or 5 balls. The choice of number of balls depends on the length of the woman's vaginal canal. The toning balls are sized to fit within a woman's vagina and are approximately 15 to 35 mm in diameter.

The cord 14 extends outward from the end of the outermost ball for easy removal from the vaginal canal. The cord 14 has a loop 16 for convenient handling of the set of toning balls; alternatively, the cord 14 has different handle comprising a knot, a thickened or textured part of the cord at the end for better grip. The cord may be nylon, cotton or anther fibrous rope; it may be a plastic length, and may contain metal wire for strength. The loop 16 may be an integral part of the cord 14 or may be attached to the cord for easy retrieval.

FIG. 2 shows two toning balls in a cut-away view. The direction of the cut is shown in FIG. 1 by the number 2 and arrows. The balls 12 comprise a non-latex rubber exterior 18, which coats a metal interior ball 20 as well as the cord 14 connecting the balls 12. The metal interior ball 20 is shown as a spherical shell having a hollow interior 22 and two inlets 24 on opposite sides of the ball through which the cord 14 passes. The metal is preferably steel and is of sufficient weight to cause substantial vibrations when two or more balls knock together. The metal interior ball 20 may be hollow or may be substantially solid with the inlets forming a hole through the center of the ball for the cord 14. The cord 14 is held in place at either end of each ball 12 by two retaining crimps 26 which press against the cord 14 at the exterior of the metal interior ball 20 but are two large to fit through the inlet 24. The retaining crimp 26 is also preferably made of steel. The cord 14, when it is exterior to the metal ball 20, the retaining crimp 26, and the metal ball 20 are each coated with the non-latex rubber exterior 18.

The non-latex rubber exterior 18 comprises a hard rubber material that is stable at temperatures up to 40° C. or more preferably 50° C. This material is a latex-free material and is preferably a surgical rubber. The rubber exterior 18 should be at least 1 mm thick but is preferably 2–20 mm thick, 4–8 mm thick, or more preferably about 6 mm thick. The exterior must be thin enough for the vibrations from the metal interior 20 to extend past the rubber exterior. The rubber exterior may have a consistent thickness over the set of toning balls, or may be thicker over the cord, over the balls, or where the cord passes through the balls. A thicker layer or rubber may be placed at the location on the balls where the most wear is seen.

The rubber material may be applied to the toning balls by dipping the balls with the cord attached into a rubber solution to create a seamless coating. Alternatively, the rubber may be molded, placed over the balls, and then treated to form a seamless coating of rubber around the balls and cord. The feminine toning balls 10 are totally sealed with the rubber exterior 18 such that no moisture permeates to the cord 14, the retaining crimp 26 or the ball 12. This is important in preventing the presence or growth of bacteria on the surface of the toning balls and creating a health risk for the user. The toning balls are coated or cleaned to form a hypoallergenic and latex free surface covering both the balls and the intervening cord.

FIG. 3 shows a set of feminine toning balls 10 having two balls where the toning balls 28 are ovate. These metal interior balls 20 are egg-shaped with the cord 14 running from the small end of the egg shape to the large, with the loop 16 of the cord 14 extending from the larger end of the ovate ball. In this embodiment of the current invention, there are two balls 28 in the set of feminine toning balls.

The toning balls of the present invention are worn internally by women. They may be place initially in warm water to wet the balls and increase their temperature to reduce any discomfort due to a difference in temperature upon insertion. A personal lubricant such as a glycerol lubricant may be used instead of or in addition to the water bath. The balls are then sequentially inserted into the vaginal canal, leaving the cord that is attached to the last ball and the loop or handle extending from the vaginal canal. The toning balls can be worn for hours without discomfort while providing the muscles in the vaginal canal with exercise. After use, the toning balls are retrieved using the loop or handle.

The exterior of the balls may be colored in a variety of colors or patterns. They may also be colored with a glow in the dark material to increase the novelty value. The exterior surface of the balls must remain hypoallergenic. The set of toning balls should be cleaned with a non-toxic antibacterial cleaner with an optional low concentration of detergent.

While a preferred embodiment of the feminine toning balls has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable weighted material may be used for the interior ball instead of the steel described.

As used herein, the terms "approximately" and "about" means within 25% of the stated value, or more preferentially within 15% of the value. As used herein, "a" or "an" may mean one or more. As used herein in the claim(s), when used in conjunction with the word "comprising", the words "a" or "an" may mean one or more than one. As used herein "another" may mean at least a second or more.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of firming or toning the pubococcygeus muscles in a woman comprising:

obtaining feminine toning balls into the vagina, wherein said balls comprise:

a plurality of metal balls connected to each other with a cord, having an exterior coating comprising a hard rubber; wherein said exterior coating seamlessly covers said metal balls and said cord extends from one of said metal balls; lubricating said toning balls; and inserting said toning balls into the vagina.

2. The method of claim 1, wherein the number of balls used depends on the length of the woman's vagina.

3. The method of claim 1, wherein said lubricating comprises wetting said toning balls with water.

4. The method of claim 1, wherein said lubricating comprises coating said toning balls with a glycerol lubricant.

* * * * *